US012686098B2

(12) United States Patent
Byun et al.

(10) Patent No.: US 12,686,098 B2
(45) Date of Patent: Jul. 21, 2026

(54) POLISHING PAD FOR CHEMICAL MECHANICAL POLISHING, CHEMICAL MECHANICAL POLISHING APPARATUS INCLUDING THE SAME, AND METHOD OF FABRICATING SEMICONDUCTOR DEVICE USING THE CHEMICAL MECHANICAL POLISHING APPARATUS

(71) Applicant: Samsung Electronics Co., Ltd., Suwon-si (KR)

(72) Inventors: Yea Rin Byun, Hwaseong-si (KR); In Kwon Kim, Hwaseong-si (KR); Bo Yun Kim, Hwaseong-si (KR); Sang Kyun Kim, Hwaseong-si (KR); Bo Un Yoon, Seoul (KR); Hyo San Lee, Seongnam-si (KR); Byung Keun Hwang, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 572 days.

(21) Appl. No.: 18/066,510

(22) Filed: Dec. 15, 2022

(65) Prior Publication Data

US 2023/0211456 A1 Jul. 6, 2023

(30) Foreign Application Priority Data

Dec. 30, 2021 (KR) ..... 10-2021-0192405

(51) Int. Cl.
*B24B 37/24* (2012.01)

(52) U.S. Cl.
CPC ..... *B24B 37/24* (2013.01)

(58) Field of Classification Search
CPC ..... B24B 37/24
See application file for complete search history.

(56) References Cited

U.S. PATENT DOCUMENTS

| | | | | |
|---|---|---|---|---|
| 8,398,462 | B2 | 3/2013 | Sung | |
| 9,238,294 | B2 | 1/2016 | Lefevre et al. | |
| 9,951,054 | B2 | 4/2018 | Li et al. | |
| 10,207,388 | B2 | 2/2019 | Chiou et al. | |
| 10,875,153 | B2 | 12/2020 | Bajaj et al. | |
| 10,946,495 | B2 | 3/2021 | Huang et al. | |
| 2009/0215363 | A1* | 8/2009 | Sung | B24B 37/24 51/296 |
| 2012/0220195 | A1 | 8/2012 | Gawase et al. | |
| 2018/0071888 | A1* | 3/2018 | Weis | B24B 53/017 |
| 2021/0069860 | A1 | 3/2021 | Chaudhari et al. | |

FOREIGN PATENT DOCUMENTS

| | | | | |
|---|---|---|---|---|
| KR | 10-2018-0117900 | A | 10/2018 | |
| KR | 10-2021-0130629 | A | 11/2021 | |
| WO | WO-9910129 | A1 * | 3/1999 | B24D 3/10 |

OTHER PUBLICATIONS

Chen and Li Effect of Oxidation degree on the thermal properties of graphene oxide. J. Mater Res Technol. 2020 9(6) pp. 13740-13748. (Year: 2020).*

* cited by examiner

*Primary Examiner* — Alexandra M Moore
(74) *Attorney, Agent, or Firm* — Wolf, Greenfield & Sacks, P.C.

(57) ABSTRACT

A polishing pad for chemical mechanical polishing includes a polymer matrix and a temperature sensitive agent dispersed in the polymer matrix and constituting 1 to 40% by volume of the polishing pad, wherein the temperature sensitive agent includes a two-dimensional (2D) sheet material having a thermal conductivity of 1 W/(m·K) or more.

14 Claims, 8 Drawing Sheets

POLISHING PAD FOR CHEMICAL MECHANICAL POLISHING, CHEMICAL MECHANICAL POLISHING APPARATUS INCLUDING THE SAME, AND METHOD OF FABRICATING SEMICONDUCTOR DEVICE USING THE CHEMICAL MECHANICAL POLISHING APPARATUS

RELATED APPLICATIONS

This application claims the benefit of Korean Patent Application No. 10-2021-0192405, filed on Dec. 30, 2021, in the Korean Intellectual Property Office, the disclosure of which is incorporated by reference herein in its entirety.

FIELD

The present disclosure relates to a polishing pad for chemical mechanical polishing, a chemical mechanical polishing apparatus including the same, and a method of fabricating a semiconductor device using the chemical mechanical polishing apparatus, and more particularly, to a polishing pad for temperature-sensitive chemical mechanical polishing, a chemical mechanical polishing apparatus including the same, and a method of fabricating a semiconductor device using the chemical mechanical polishing apparatus.

BACKGROUND

In a semiconductor device fabrication process, a chemical mechanical polishing process is widely used as a planarization technique for removing a step difference between layers formed on a substrate. The chemical mechanical polishing process can efficiently planarize the layers formed on the substrate by injecting a polishing slurry containing abrasive particles between the substrate and a polishing pad and rubbing the substrate and the polishing pad against each other.

In a chemical mechanical polishing process based on a chemical reaction, a polishing temperature causes polishing properties of the chemical mechanical polishing process to change. Therefore, research is being conducted on a method of efficiently controlling the polishing temperature to achieve required polishing properties.

SUMMARY

Aspects of the present disclosure provide a polishing pad for chemical mechanical polishing which improves productivity and uniformity of a chemical mechanical polishing process.

Aspects of the present disclosure also provide a chemical mechanical polishing apparatus which improves productivity and uniformity of a chemical mechanical polishing process.

Aspects of the present disclosure also provide a method of fabricating a semiconductor device with improved productivity and uniformity.

However, aspects of the present disclosure are not restricted to the ones set forth herein. The above and other aspects of the present disclosure will become more apparent to one of ordinary skill in the art to which the present disclosure pertains by referencing the detailed description of the present disclosure given below.

According to an aspect of the present disclosure, there is provided a polishing pad for chemical mechanical polishing, the polishing pad including a polymer matrix and a temperature sensitive agent dispersed in the polymer matrix and constituting 1 to 40% by volume of the polishing pad, wherein the temperature sensitive agent includes a two-dimensional (2D) sheet material having a thermal conductivity of 1 W/(m·K) or more.

According to an aspect of the present disclosure, there is provided a polishing pad for chemical mechanical polishing, the polishing pad including a polymer matrix and a temperature sensitive agent dispersed in the polymer matrix, wherein the temperature sensitive agent includes at least one of graphene, graphene oxide, hexagonal boron nitride, graphitic carbon nitride, amorphous vanadium pentoxide, black phosphorous, silicene, and arsenene.

According to another aspect of the present disclosure, there is provided a chemical mechanical polishing apparatus including a rotatable platen, a polishing pad on the platen, a polishing head assembly configured to provide a wafer onto the polishing pad, a slurry supply unit configured to provide a slurry for chemical mechanical polishing onto the polishing pad and a temperature controller configured to control a polishing temperature for the wafer, wherein the polishing pad includes a polymer matrix and a temperature sensitive agent dispersed in the polymer matrix, and the temperature sensitive agent includes a 2D sheet material having a thermal conductivity of 1 W/(m·K) or more.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
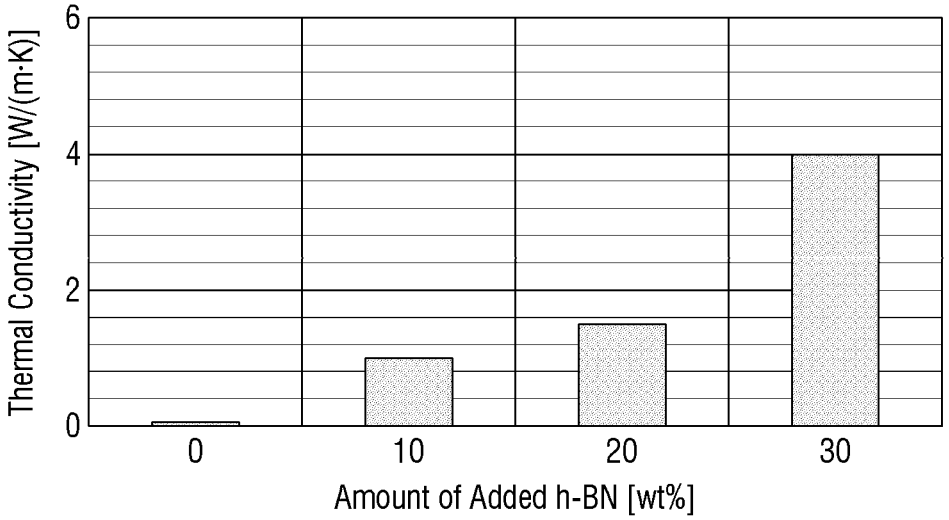
FIG. 1 is a graph illustrating the change in thermal conductivity of a polishing pad with respect to the amount of h-BN added.

Hereinafter, a polishing pad for chemical mechanical polishing according to example embodiments will be described.

A polishing pad for chemical mechanical polishing according to some embodiments includes a polymer matrix and a temperature sensitive agent.

The polymer matrix is a material serving as a base of the polishing pad for chemical mechanical polishing and may include a polymer having excellent strength, flexibility, and durability. For example, the polymer matrix may include, but is not limited to, at least one of polyurethane, polyester, polyether, epoxy, polyimide, polycarbonate, polyethylene, polypropylene, latex, nitrile-butadiene rubber (NBR), isoprene rubber, and combinations thereof.

Preferably, the polymer matrix may include at least one of polyurethane; polyolefins such as polyethylene and polypropylene; polycarbonate; and combinations thereof. In an example, the polymer matrix may include polyurethane.

The temperature sensitive agent may be dispersed in the polymer matrix. The temperature sensitive agent may improve the thermo-sensitivity of the polishing pad for chemical mechanical polishing. The temperature sensitive agent may include a two-dimensional (2D) sheet material having a relatively high thermal conductivity compared to the polymer matrix. In some embodiments, the thermal conductivity of the temperature sensitive agent may be equal to or greater than about 1 W/(m·K). For example, the thermal conductivity of the temperature sensitive agent may be about 1 to about 10,000 W/(m·K).

For example, the temperature sensitive agent may include, but is not limited to, at least one of graphite, graphene, graphene oxide (GO), hexagonal boron nitride (h-BN), graphitic carbon nitride (g-CN), amorphous vanadium pentoxide (a-$V_2O_5$), black phosphorous, silicene, arsenene, and combinations thereof.

Preferably, the temperature sensitive agent may include at least one of graphene, graphene oxide (GO), hexagonal boron nitride (h-BN), graphitic carbon nitride (g-CN), amorphous vanadium pentoxide (a-$V_2O_5$), black phosphorous, silicene, and arsenene. For example, the temperature sensitive agent may include hexagonal boron nitride (h-BN). For another example, the temperature sensitive agent may include graphene.

The temperature sensitive agent may be included in an amount of about 0.1 to about 50% by volume based on 100% by volume of the polishing pad for chemical mechanical polishing. When the temperature sensitive agent is included in an amount of about 0.1% by volume or more, the temperature sensitivity of the polishing pad for chemical mechanical polishing is improved. Therefore, the polishing time of the chemical mechanical polishing process may be shortened, and the flatness of a polishing target layer may be improved. When the temperature sensitive agent is included in an amount exceeding about 50% by volume, the polishing rate of the polishing target layer may be reduced. Preferably, the temperature sensitive agent may be included in an amount of about 1 to about 40% by volume based on 100% by volume of the polishing pad for chemical mechanical polishing.

In some embodiments, the polishing pad for chemical mechanical polishing may have a thermal conductivity of about 0.1 W/(m·K) or more. For example, the thermal conductivity of the polishing pad for chemical mechanical polishing may be about 0.1 to about 5.0 W/(mK).

In some embodiments, the polishing pad for chemical mechanical polishing may be a polishing pad for polishing a metal layer. The metal layer may include, but is not limited to, at least one of, for example, tungsten (W), copper (Cu), ruthenium (Ru), molybdenum (Mo), aluminum (Al), platinum (Pt), and combinations thereof.

In some embodiments, the polishing pad for chemical mechanical polishing may be prepared by adding the temperature sensitive agent to a polyurethane precursor composition to form a mixture and then curing the mixture.

The polyurethane precursor composition may be formed by mixing a curing agent with a polyurethane precursor obtained by a reaction between an isocyanate compound and a polyol compound.

The isocyanate compound may be aliphatic isocyanate and/or aromatic isocyanate. For example, the isocyanate compound may be diisocyanate, for example, and may include, but is not limited to, at least one of ethylene diisocyanate, hexamethylene diisocyanate, bis(isocyanatomethyl)cyclohexane, norbornane diisocyanate, isophorone diisocyanate, dicyclohexylmethane diisocyanate, toluene diisocyanate, naphthalene diisocyanate, phenylene diisocyanate, tolidine diisocyanate, 2,2'-diphenylmethane diisocyanate, 2,4'-diphenylmethane diisocyanate, 4,4'-diphenylmethane diisocyanate, xylene diisocyanate, and combinations thereof.

The polyol compound may include, but is not limited to, at least one of, for example, polyether polyol, polyester polyol, polycarbonate polyol, polyester polycarbonate polyol, acryl polyol, and combinations thereof.

The polyurethane precursor composition may be a photocurable polyurethane precursor composition or a heat-curable polyurethane precursor composition. The photocurable polyurethane precursor composition may include a photocurable polyurethane precursor. The photocurable polyurethane precursor may include, but is not limited to, for example, urethane methacrylate. The urethane methacrylate may be prepared, for example, by polymerizing an isocyanate compound and a polyol compound and then additionally reacting methacrylate.

The methacrylate compound may include, but is not limited to, at least one of, for example, 2-hydroxyethyl methacrylate, 2-hydroxypropyl methacrylate, 4-hydroxybutyl methacrylate, pentaerythritol trimethacrylate, and combinations thereof.

The urethane methacrylate may have one or two methacrylate groups (e.g., $CH_2{=}CHC({=}O)O{-}$ or $CH_2{=}C(CH_3)C({=}O)O{-}$) at an end of a core with a urethane moiety.

The methacrylate group at the end may be a crosslinkable functional group and may be a kind of chemical crosslinking site.

The polyurethane precursor composition may further include a reaction initiator. The reaction initiator may include, but is not limited to, at least one of, for example, benzophenone, methylbenzophenone, chlorobenzophenone, acetophenone, benzyldimethylketal, diethylthioxanthone, diphenyl(2,4,6-trimethylbenzoyl)phosphine oxide, anthraquinone, and combinations thereof.

The polyurethane precursor composition may optionally further include an organic solvent. The organic solvent may include, but is not limited to, at least one of, for example, ketone solvents such as acetone, methyl ethyl ketone, and methyl isobutyl ketone; cyclic ether solvents such as tetrahydrofuran and dioxolane; ester solvents such as methyl acetate, ethyl acetate, and butyl acetate; aromatic solvents such as toluene and xylene; alicyclic solvents such as cyclohexane and methyl cyclohexane; alcohol solvents such as carbitol, cellosolve, methanol, isopropanol, butanol, and propylene glycol monomethyl ether; glycol ether solvents such as ethylene glycol monoethyl ether, ethylene glycol monobutyl ether, propylene glycol monomethyl ether, and propylene glycol monopropylene ether; and combinations thereof.

The curing agent may include, but is not limited to, at least one of, for example, an aliphatic amine compound, an aromatic amine compound, an aliphatic alcohol compound, an aromatic alcohol compound, and combinations thereof.

In some embodiments, an inert gas may be supplied to the polyurethane precursor composition to produce porous polyurethane. The inert gas may include, but is not limited to, at least one of, for example, nitrogen gas, argon gas, helium gas, and combinations thereof. The inert gas may be uniformly supplied to the mixture of the polyurethane precursor and the curing agent. The size and density of pores of the porous polyurethane may be controlled by the type, supply flow rate and/or supply pressure, etc. of the inert gas.

The mixture of the polyurethane precursor composition and the temperature sensitive agent may be injected into a predetermined mold and then cured. Accordingly, a polishing pad for chemical mechanical polishing may be prepared in a form solidified according to the shape of the mold. The polishing pad for chemical mechanical polishing may be, for example, in the form of a cake, but the present disclosure is not limited thereto.

The polishing pad for chemical mechanical polishing according to the example embodiments will now be described in more detail with reference to the following examples, the following comparative example, and FIGS. 1 and 2. The following examples are merely illustrative, and the technical spirit and scope of the present disclosure is not limited to these examples.

Example 1

A mixture was prepared by dispersing 10% by weight of hexagonal boron nitride (h-BN) as the temperature sensitive agent in a polyurethane precursor composition using urethane methacrylate as the polyurethane precursor. The prepared mixture was injected into a mold and cured to produce a polishing pad for chemical mechanical polishing.

Example 2

A polishing pad for chemical mechanical polishing was prepared in the same manner as in Example 1, except that the content of the temperature sensitive agent in Example 1 was changed to 20% by weight.

Example 3

A polishing pad for chemical mechanical polishing was prepared in the same manner as in Example 1, except that the content of the temperature sensitive agent in Example 1 was changed to 30% by weight.

Example 4

A polishing pad for chemical mechanical polishing was prepared in the same manner as in Example 1, except that 0.5% by weight of graphene was used as the temperature sensitive agent unlike in Example 1.

Example 5

A polishing pad for chemical mechanical polishing was prepared in the same manner as in Example 1, except that the content of the temperature sensitive agent in Example 4 was changed to 1.0% by weight.

Comparative Example

A polishing pad for chemical mechanical polishing was prepared in the same manner as in Example 1, except that the temperature sensitive agent was not added unlike in Example 1.

[Thermal Conductivity Evaluation 1]

The thermal conductivity of each of the polishing pads for chemical mechanical polishing prepared according to Examples 1 through 3 and Comparative Example was measured and shown in FIG. 1. Specifically, FIG. 1 is a graph illustrating the change in thermal conductivity of a polishing pad with respect to the amount of h-BN added.

Referring to FIG. 1, it can be seen that the polishing pads for chemical mechanical polishing prepared according to Examples 1 through 3 have a thermal conductivity (e.g., a thermal conductivity of about 1.0 W/(m·K) or more) increased by about 30 times or more than the thermal conductivity of the polishing pad for chemical mechanical polishing prepared according to Comparative Example.

[Thermal Conductivity Evaluation 2]

Figure 2:
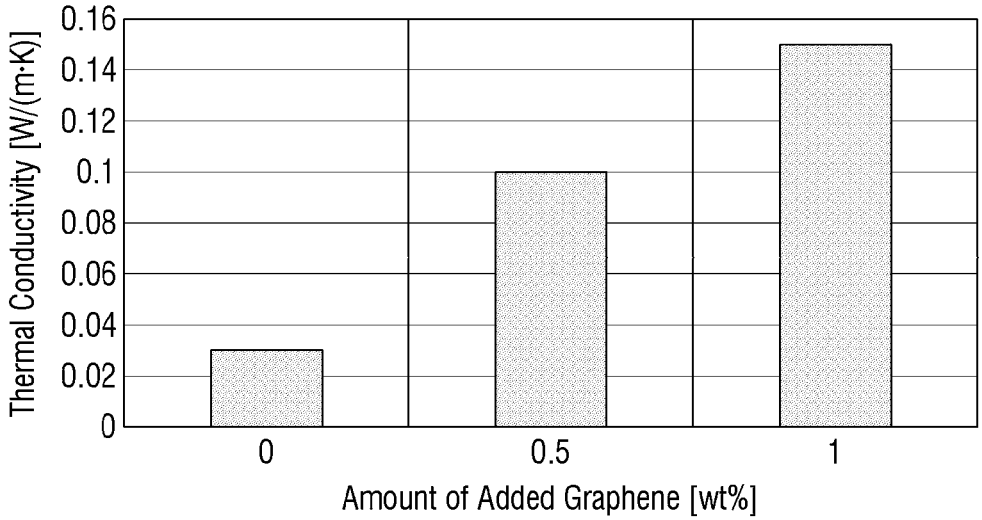
FIG. 2 is a graph illustrating the change in thermal conductivity of a polishing pad with respect to the amount of graphene added.

The thermal conductivity of each of the polishing pads for chemical mechanical polishing prepared according to Example 4, Example 5, and Comparative Example was measured and shown in FIG. 2. Specifically, FIG. 2 is a graph illustrating the change in thermal conductivity of a polishing pad with respect to the amount of graphene added.

Referring to FIG. 2, it can be seen that the polishing pads for chemical mechanical polishing prepared according to Examples 4 and 5 have a thermal conductivity (e.g., a thermal conductivity of about 0.1 W/(m·K) or more) increased by about 3 times or more than the thermal conductivity of the polishing pad for chemical mechanical polishing prepared according to Comparative Example.

In a chemical mechanical polishing process based on a chemical reaction, a polishing temperature causes polishing properties of the chemical mechanical polishing process to change. For example, at the beginning of the polishing process, unit per equipment hour (UPEH) may decrease due to a low polishing temperature, and a predetermined polishing temperature may be required to achieve the required UPEH. However, as the polishing process progresses, the polishing temperature may increase due to friction between a wafer and a polishing pad, and such a change in polishing temperature may reduce polishing uniformity. Therefore, research is being conducted on a method of efficiently controlling the polishing temperature to achieve required polishing properties.

The polishing pad for chemical mechanical polishing according to the embodiments herein can efficiently control the polishing temperature because it includes the temperature sensitive agent. Specifically, as described above with reference to FIGS. 1 and 2, the polishing pad for chemical mechanical polishing according to the embodiments has improved temperature sensitivity (e.g., a thermal conductivity of about 0.1 W/(m·K) or more) by including the temperature sensitive agent. Therefore, the polishing pad can be heated or cooled faster to a required polishing temperature. Accordingly, the polishing pad for chemical mechanical polishing according to the embodiments herein can provide improved productivity and uniformity in a chemical mechanical polishing process.

A chemical mechanical polishing apparatus using a slurry composition for chemical mechanical polishing according to example embodiments will now be described with reference to FIG. 3.

Figure 3:
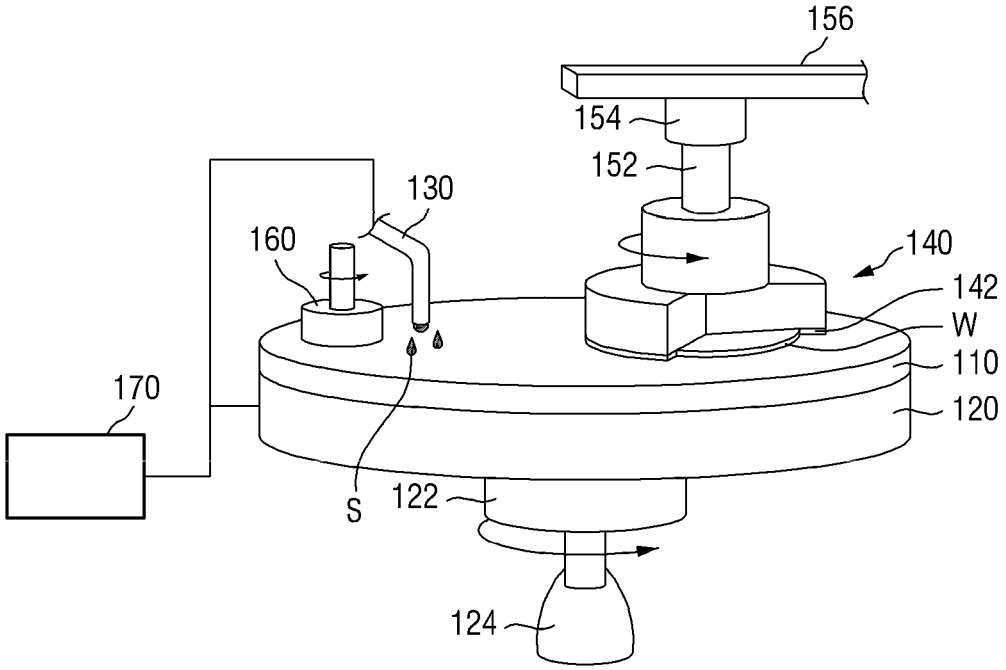
FIG. 3 is a schematic perspective view of a chemical mechanical polishing apparatus according to embodiments.

FIG. 3 is a schematic perspective view of a chemical mechanical polishing apparatus according to embodiments. The chemical mechanical polishing apparatus according to FIG. 3 is merely an example, and the technical spirit and scope of the present disclosure is not limited to this apparatus.

Referring to FIG. 3, the chemical mechanical polishing apparatus according to the embodiments includes a polishing pad 110, a platen 120, a slurry supply unit 130, a carrier head assembly 140, a pad conditioner 160, and a temperature controller 170.

The polishing pad 110 may be disposed on the platen 120. The polishing pad 110 may include the above-described polishing pad for chemical mechanical polishing. For example, the polishing pad 110 may include the polymer matrix and the temperature sensitive agent. The polishing pad 110 may be provided as, but not limited to, a plate having a predetermined thickness, for example, a circular plate. The polishing pad 110 may include a polishing surface having a predetermined roughness. While a chemical mechanical polishing process is being performed, the polishing surface of the polishing pad 110 may contact a wafer W to polish the wafer W.

The polishing pad 110 may include a porous material having a plurality of microspaces. The microspaces of the polishing pad 110 may accommodate a polishing slurry S provided while the chemical mechanical polishing process is performed.

In some embodiments, the polishing pad 110 may further include a conductive material. The polishing pad 110, which is a conductor, may be grounded to prevent a short circuit. In some other embodiments, the polishing pad 110 may be a non-conductor.

The platen 120 may be rotatable. The rotatable platen 120 may rotate the polishing pad 110 disposed on the platen 120. For example, a first driving shaft 122 connected to the bottom of the platen 120 may be rotated by rotational power from a first motor 124. The platen 120 may rotate the polishing pad 110 about a rotation axis perpendicular to an upper surface of the platen 120.

The slurry supply unit 130 may be disposed adjacent to the polishing pad 110. While the chemical mechanical polishing process is being performed, the slurry supply unit 130 may supply the polishing slurry S onto the polishing pad 110. The polishing slurry S may include, but is not limited to, for example, a reactant (e.g., deionized water for oxidative polishing), abrasive particles (e.g., silica for oxidative polishing), and/or a chemical reaction catalyst (e.g., potassium hydroxide for oxidative polishing).

The carrier head assembly 140 may be disposed adjacent to the polishing pad 110. The carrier head assembly 140 may provide the wafer W onto the polishing pad 110. The carrier head assembly 140 may operate to hold the wafer W against the polishing pad 110. The carrier head assembly 140 may independently control a polishing parameter (e.g., pressure, etc.) related to each wafer W.

For example, the carrier head assembly 140 may include a retaining ring 142 for retaining the wafer W under a flexible membrane. The carrier head assembly 140 may include a plurality of pressurizable chambers that are defined by the flexible membrane and independently controllable. The pressurizable chambers may apply independently controllable pressures to relevant regions on the flexible membrane or to relevant regions on the wafer W.

The carrier head assembly 140 may be rotatable. The rotatable carrier head assembly 140 may rotate the wafer W fixed to the carrier head assembly 140. For example, a second driving shaft 152 connected to the top of the carrier head assembly 140 may be rotated by rotational power from a second motor 154.

The carrier head assembly 140 may be supported by a support structure 156. The support structure 156 may be, but is not limited to, for example, a carousel or a track. In some embodiments, the carrier head assembly 140 may translate laterally across an upper surface of the polishing pad 110. For example, the carrier head assembly 140 may vibrate on a slider of the support structure 156 or may vibrate due to rotational vibration of the support structure 156 itself.

Although only one carrier head assembly 140 is provided on the polishing pad 110 in FIG. 3, this is merely an example. For another example, a plurality of carrier head assemblies 140 may also be provided on the polishing pad 110 to efficiently use the surface area of the polishing pad 110. In addition, although a rotation direction of the platen 120 and a rotation direction of the carrier head assembly 140 are the same in FIG. 3, this is merely an example. The platen 120 and the carrier head assembly 140 may also rotate in different rotation directions.

The pad conditioner 160 may be disposed adjacent to the polishing pad 110. The pad conditioner 160 may perform a conditioning process on the polishing pad 110. The pad conditioner 160 may stably maintain the polishing surface of the polishing pad 110 so that the wafer W is effectively polished during the chemical mechanical polishing process.

The temperature controller 170 may control a polishing temperature at which the chemical mechanical polishing process is performed on the wafer W. For example, the temperature controller 170 may be connected to the platen 120 to heat or cool the temperature of the polishing pad 110 disposed on the platen 120. Alternatively, for example, the temperature controller 170 may be connected to the slurry supply unit 130 to heat or cool the temperature of the polishing slurry S supplied from the slurry supply unit 130. The temperature controller 170 may include, but is not limited to, for example, a temperature controlling device.

The chemical mechanical polishing apparatus according to the embodiments can efficiently control the polishing temperature by using the above-described polishing pad for chemical mechanical polishing. Specifically, the polishing pad 110 may have improved temperature sensitivity because it includes the temperature sensitive agent. Therefore, when the polishing temperature is controlled by a temperature controller (e.g., 170 in FIG. 3), the polishing pad 110 can be heated or cooled faster to a required polishing temperature. Accordingly, the chemical mechanical polishing apparatus according to the embodiments can provide improved productivity and uniformity in the chemical mechanical polishing process.

A method of fabricating a semiconductor device using a slurry composition for chemical mechanical polishing according to example embodiments will now be described with reference to FIGS. 4 through 8.

FIGS. 4 through 8 are views illustrating intermediate steps of a method of fabricating a semiconductor device according to embodiments. The method of fabricating the semiconductor device according to FIGS. 4 through 8 is merely an example, and the technical spirit and scope of the present disclosure is not limited to this fabrication method.

Figure 4:
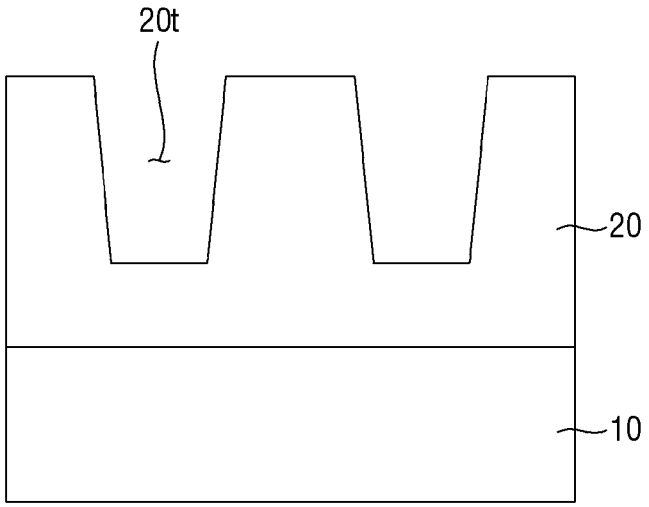
FIGS. 4 through 8 are views illustrating intermediate steps of a method of fabricating a semiconductor device according to embodiments.

Referring to FIG. 4, an interlayer insulating film 20 is formed on a semiconductor substrate 10.

The semiconductor substrate 10 may be or include, for example, bulk silicon or silicon-on-insulator (SOI). The semiconductor substrate 10 may be or include a silicon substrate or a substrate made of another material such as silicon germanium, indium antimonide, lead telluride, indium arsenide, indium phosphide, gallium arsenide, or gallium antimonide. Alternatively, the silicon substrate 10 may consist of or include a base substrate and an epitaxial layer formed on the base substrate.

The interlayer insulating film 20 may include trenches **20*t*. For example, an etching process may be performed on the interlayer insulating film 20 to form the trenches 20*t* in the interlayer insulating film 20. A width of each of the trenches 20*t* may be, for example, about 20 nm or less. For example, the width of each of the trenches 20*t* may be about 1 to about 15 nm. The interlayer insulating film 20** may include an insulating material, for example, and may include, but is not limited to, at least one of silicon oxide, silicon nitride, silicon oxynitride, and combinations thereof.

Figure 5:
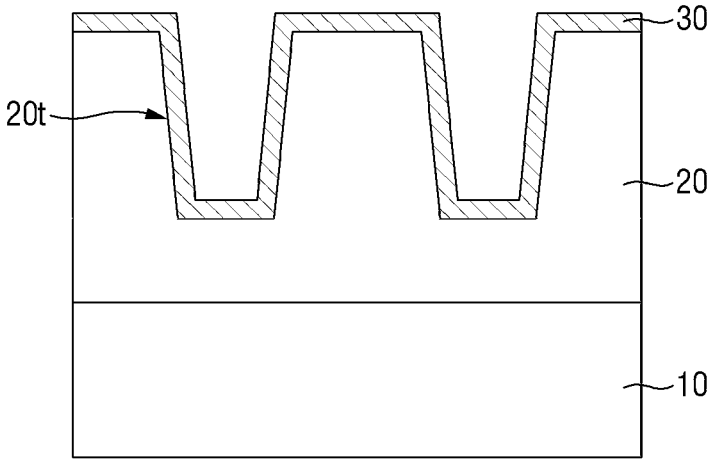

Referring to FIG. 5, a barrier layer 30 is formed on the interlayer insulating film 20.

The barrier layer 30 may extend along the profile of the interlayer insulating film 20 and the profile of the trenches 20*t*. The barrier layer 30 may include metal or metal nitride for preventing diffusion of a metal layer 40 (see FIG. 6) which will be described below. For example, the barrier layer 30 may include, but is not limited to, at least one of titanium (Ti), tantalum (Ta), tungsten (W), nickel (Ni), cobalt (Co), platinum (Pt), alloys thereof, nitrides thereof, and combinations thereof.

Figure 6:
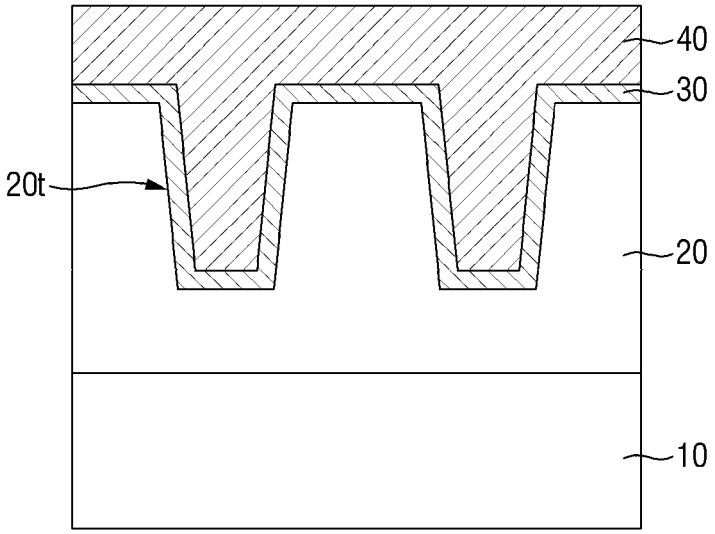

Referring to FIG. 6, the metal layer 40 is formed on the barrier layer 30.

The metal layer 40 may cover the barrier layer 30. The metal layer 40 may fill a region of each trench 20*t* remaining after being filled with or covered by the barrier layer 30. The metal layer 40 may include a conductive material, for example, may include, but is not limited to, at least one of tungsten (W), copper (Cu), ruthenium (Ru), molybdenum (Mo), aluminum (Al), platinum (Pt), and combinations thereof. For example, the metal layer 40 may include tungsten (W).

Figure 7:
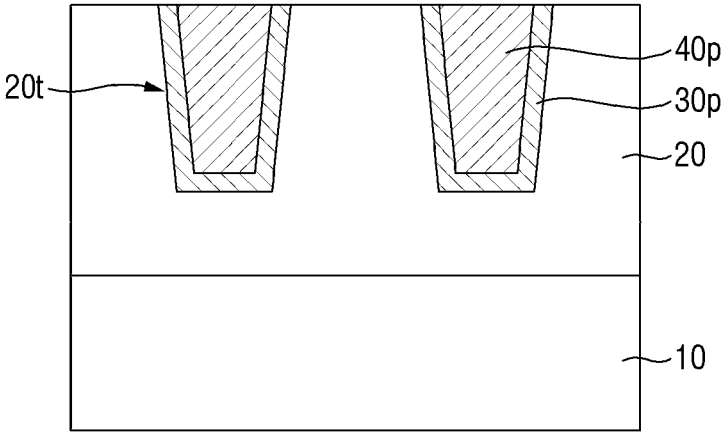

Referring to FIG. 7, a chemical mechanical polishing process is performed.

The chemical mechanical polishing process may use the above-described polishing pad for chemical mechanical polishing. For example, the chemical mechanical polishing process may be performed by the chemical mechanical polishing apparatus described above with reference to FIG. 3.

As the chemical mechanical polishing process is performed, barrier patterns 30*p* and metal patterns 40*p* may be formed in the interlayer insulating film 20. For example, the chemical mechanical polishing process may be performed until a top surface of the interlayer insulating film 20 is exposed. The barrier patterns 30*p* and the metal patterns 40*p* may be sequentially stacked to fill the trenches 20*t*. The metal patterns 40*p* may form metal wirings of a semiconductor device, but the present disclosure is not limited thereto.

Figure 8:
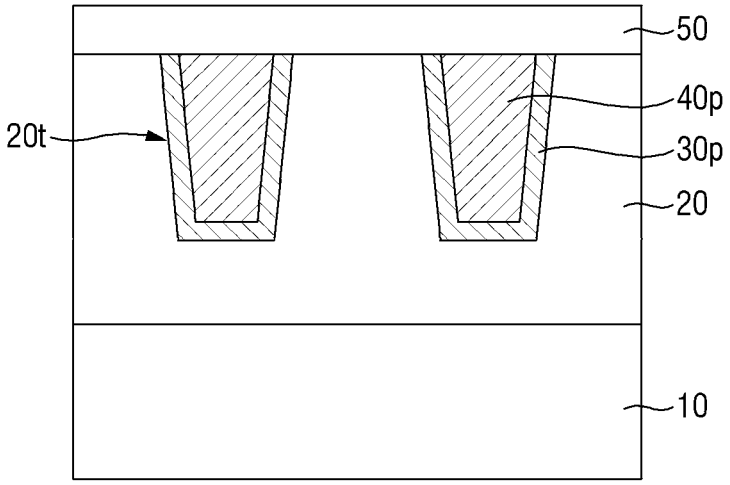

Referring to FIG. 8, a capping layer 50 is formed.

The capping layer 50 may cover the interlayer insulating film 20, the barrier patterns 30*p*, and the metal patterns 40*p*. The capping layer 50 may include an insulating material, for example, and may include, but is not limited to, at least one of silicon nitride, silicon carbide, and combinations thereof. In some other embodiments, the capping layer 50 may be omitted.

The method of fabricating the semiconductor device according to the embodiments herein provides improved productivity and uniformity by using the above-described polishing pad for chemical mechanical polishing. Specifically, since the above-described polishing pad for chemical mechanical polishing may have improved temperature sensitivity by including the temperature sensitive agent, it can provide improved productivity and uniformity in a chemical mechanical polishing process. Accordingly, the method of fabricating the semiconductor device according to the embodiments herein can provide a semiconductor device with improved productivity and uniformity.

In concluding the detailed description, those skilled in the art will appreciate that many variations and modifications may be made to the preferred embodiments without substantially departing from the principles of the present disclosure. Therefore, the disclosed preferred embodiments of the disclosure are used in a generic and descriptive sense only and not for purposes of limitation.

What is claimed is:

1. A polishing pad for chemical mechanical polishing, the polishing pad comprising:

a polymer matrix;

a temperature sensitive agent dispersed in the polymer matrix and constituting 1 to 40% by volume of the polishing pad; and a continuous polishing surface configured to polish a wafer, the continuous polishing surface comprising the polymer matrix and the temperature sensitive agent, wherein the temperature sensitive agent comprises a two-dimensional (2D) sheet material having a thermal conductivity of 1 W/(m·K) or more.

2. The polishing pad of claim 1, wherein the 2D sheet material comprises at least one of graphene, graphene oxide, hexagonal boron nitride, graphitic carbon nitride, amorphous vanadium pentoxide, black phosphorous, silicene, and arsenene.

3. The polishing pad of claim 2, wherein the 2D sheet material comprises at least one of graphene and hexagonal boron nitride.

4. The polishing pad of claim 1, wherein the polymer matrix comprises at least one of polyurethane, polyolefin, and polycarbonate.

5. The polishing pad of claim 4, wherein the polymer matrix comprises polyurethane.

6. The polishing pad of claim 1, wherein the polishing pad has a thermal conductivity of 0.1 W/(m·K) or more.

7. The polishing pad of claim 1, wherein the polishing pad is a polishing pad for polishing a metal layer.

8. A polishing pad for chemical mechanical polishing, the polishing pad comprising:

a polymer matrix;

a temperature sensitive agent dispersed in the polymer matrix; and a continuous polishing surface configured to polish a wafer, the continuous polishing surface comprising the polymer matrix and the temperature sensitive agent, wherein the temperature sensitive agent comprises at least one of graphene, graphene oxide, hexagonal boron nitride, graphitic carbon nitride, amorphous vanadium pentoxide, black phosphorous, silicene, and arsenene.

9. The polishing pad of claim 8, comprising 1 to 40% by volume of the temperature sensitive agent based on 100% by volume of the polishing pad for chemical mechanical polishing.

10. The polishing pad of claim 8, wherein the temperature sensitive agent comprises hexagonal boron nitride.

11. The polishing pad of claim 10, wherein the polishing pad has a thermal conductivity of 1 W/(m·K) or more.

12. The polishing pad of claim 8, wherein the temperature sensitive agent comprises graphene.

13. The polishing pad of claim 12, wherein the polishing pad has a thermal conductivity of 0.1 W/(m·K) or more.

14. The polishing pad of claim 8, wherein the polishing pad is configured to polish a metal layer.

* * * * *